US005765943A

United States Patent [19]

Verdier

[11] Patent Number: 5,765,943

[45] Date of Patent: Jun. 16, 1998

[54] MULTI-PORT PROJECTOR IMPROVING THE UNIFORMITY OF THE ILLUMINATED FIELD

[75] Inventor: Alain Verdier, Saint just Saint Rambert, France

[73] Assignee: ALM, Le Pre Saint Gervais, France

[21] Appl. No.: 725,558

[22] Filed: Oct. 3, 1996

[30] Foreign Application Priority Data

Oct. 5, 1995 [FR] France ..... 95 11719

[51] Int. Cl.[6] ..... F21V 13/04

[52] U.S. Cl. ..... 362/268; 362/33; 362/804

[58] Field of Search ..... 362/33, 268, 298, 362/336, 338, 340, 346, 804

[56] References Cited

U.S. PATENT DOCUMENTS

| | | | |
|---|---|---|---|
| 1,277,110 | 8/1918 | Patterson | 362/33 |
| 3,848,119 | 11/1974 | Masson et al. | 362/268 |
| 4,068,117 | 1/1978 | Masson | 362/33 |
| 4,912,613 | 3/1990 | Sanborn | 362/336 |

FOREIGN PATENT DOCUMENTS

| | | | |
|---|---|---|---|
| 0792629 | 10/1935 | France | 362/33 |
| 2109954 | 5/1972 | France . | |
| 2 339 129 | 8/1977 | France . | |
| 1 034 116 | 7/1958 | Germany . | |
| 33 24 028 | 1/1985 | Germany . | |

*Primary Examiner*—Y My Quach
*Attorney, Agent, or Firm*—Young & Thompson

[57] ABSTRACT

A projector comprises optical elements arranged each to constitute a passage port comprising, on the one hand, a first lens ($d_1$) ensuring focussing of the light source (3) in the plane to be illuminated, whilst optimizing the correction of optical aberrations and, on the other hand, a second lens ($d_2$) ensuring a multiplication of the image of the source to permit rendering uniform the illumination in the illuminated plane.

7 Claims, 2 Drawing Sheets

MULTI-PORT PROJECTOR IMPROVING THE UNIFORMITY OF THE ILLUMINATED FIELD

FIELD OF THE INVENTION

The present invention relates to the technical field of light projectors used in the medical field and, in particular, adapted for surgical operating rooms.

The object of the invention is more particularly projectors of the multi-port kind, which is to say those comprising one or several light sources from each of which is formed a series of illuminating light beams.

BACKGROUND OF THE INVENTION

There are known in the prior art various types of illuminating projectors, such as those described above, designed to permit elimination of shadows and the obtention of a uniform field of illumination of high luminous intensity, with cold lighting.

For example, French patent 2,339,129 discloses an illuminating projector comprising, in a casing, two lighting systems each comprising a luminous source on opposite sides of which are disposed a ground glass field and an optical condenser system comprised by two lenses forming a principal light beam. An optical element is disposed in the path of each principal light beam to form, after reflection from a mirror and passage through a port provided in the housing, an image of the ground glass field in the plane of utilization to be illuminated. Thus, the plane of utilization in question is illuminated by light beams from mirrors which are suitably oriented such that the axes of the beams converge toward the same point corresponding to the center of the field to be illuminated.

Such a projector is designed to eliminate shadows permitting its particular use in surgical operating rooms. This projector also permits obtaining a uniform field of illumination of high intensity light with cold lighting. Moreover, it is to be noted that the luminous sources are disposed in the central region of the housing from which extend radial arms arranged to comprise passage ports for light beams. The provision of the projector in the form of a star-shaped housing offers the advantage of limiting its size or obstruction in the horizontal plane, whilst permitting disturbing as little as possible the ventilation of the space within which the projector is installed.

Such a projector is satisfactory in practice. However, it has been noted that the ground glass fields located in immediate adjacency to the light source to ensure uniformity of the illuminated field, lead to decrease of the output of the projector because of the index of diffusion of the ground glass which can greatly vary as a function of the fineness thereof. There have also been noted colored hallows at the margins of the illuminated field.

SUMMARY OF THE INVENTION

The present invention therefore seeks to overcome the drawbacks set forth above and to provide a projector permitting improved uniformity of the illuminated field and sharpness of the outline of the illuminated field.

To achieve this objective, the object of the invention is an illuminating projector adapted in particular for surgical operating rooms, of the type comprising a housing, at least one illuminating system comprising at least one light source from which are formed at least two principal light beams, in the path of each of which is disposed an optical element adapted to form an image of the light source in the plane to be illuminated, after reflection from a mirror and passage through said optical element and through a port provided in the housing.

According to the invention, for each illuminating system, the optical elements are arranged each to constitute a passage port comprising on the one hand a first lens surface ensuring focussing of the light source on the plane to be illuminated, whilst optimizing the correction of optical aberrations, and, on the other hand, a second lens surface ensuring multiplication of the image of the source to permit uniformity of illumination in the illuminated plane.

Another object of the invention is to eliminate another drawback of the projector disclosed in French patent 2 339 129, having to do with the fact that there is interposed in the path of the light beam, between a mirror and the light source, an intermediate return mirror. The optical paths of the beams from the intermediate mirror and from the end mirror are of different lengths. It follows that the contributions of each beam are not geometrically identical, such that the illuminated field does not have a uniform shape.

The object of the invention is also to provide a projector in which the number of light beams illuminating the region is increased, without however increasing the number of optical elements and whilst controlling the contributions provided by each beam. To achieve this object, the projector according to the invention is characterized in that at least one of the optical elements constitutes a passage port for a light beam to arrive from the principal beam, by an intermediate return mirror interposed between one mirror and the light source and letting pass the other portion of the principal beam in the direction of the associated return mirror, the optical element having a first lens surface adapted to regulate the size of the light spot created by the beam in the plane to be illuminated.

According to a preferred characteristic of the invention, the optical elements are adapted such that the first lens surface permits forming the image of the light source in a single common plane permitting obtaining a superposition of the different beams, so as to obtain an illuminated field having a uniform shape.

BRIEF DESCRIPTION OF THE DRAWINGS

Various other characteristics will become apparent from the following description with reference to the accompanying drawings which show, by way of non-limiting example, embodiments of structure and operation of the object of the invention.

DESCRIPTION OF THE PREFERRED EMBODIMENTS

Figure 1:
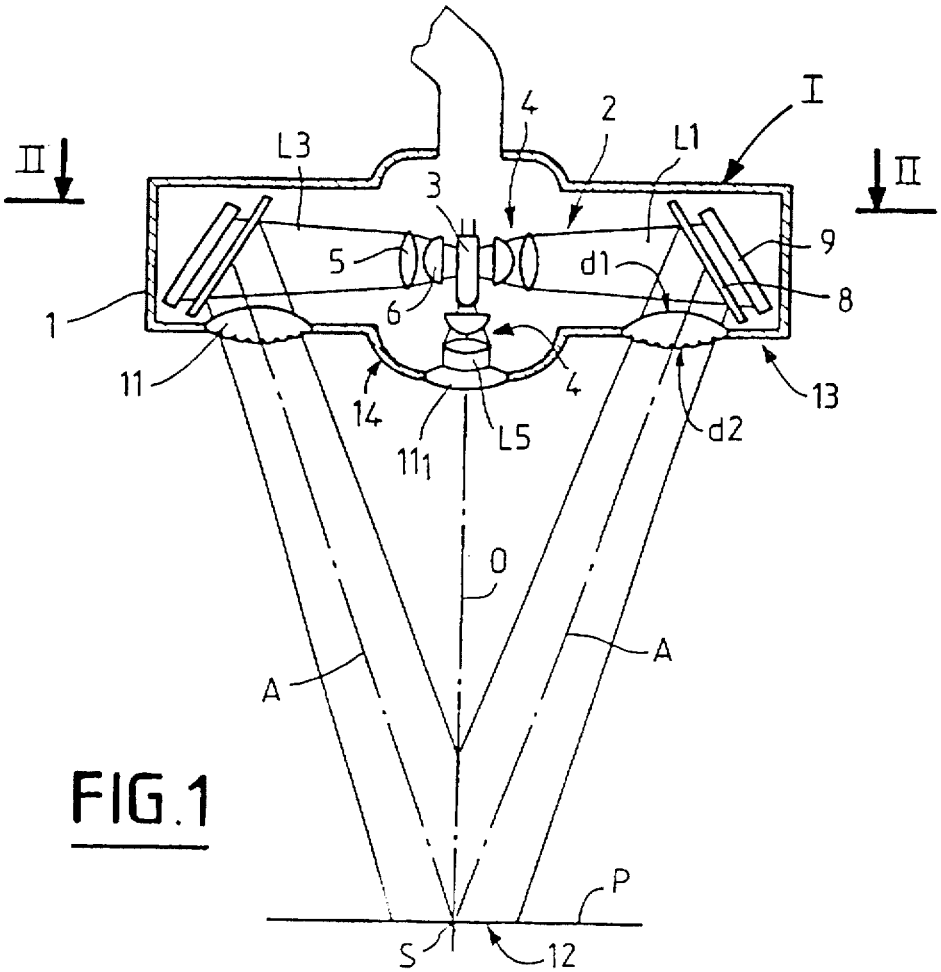
FIG. 1 is a partial vertical cross section showing a first embodiment of the illuminating projector according to the invention.
Figure 2:
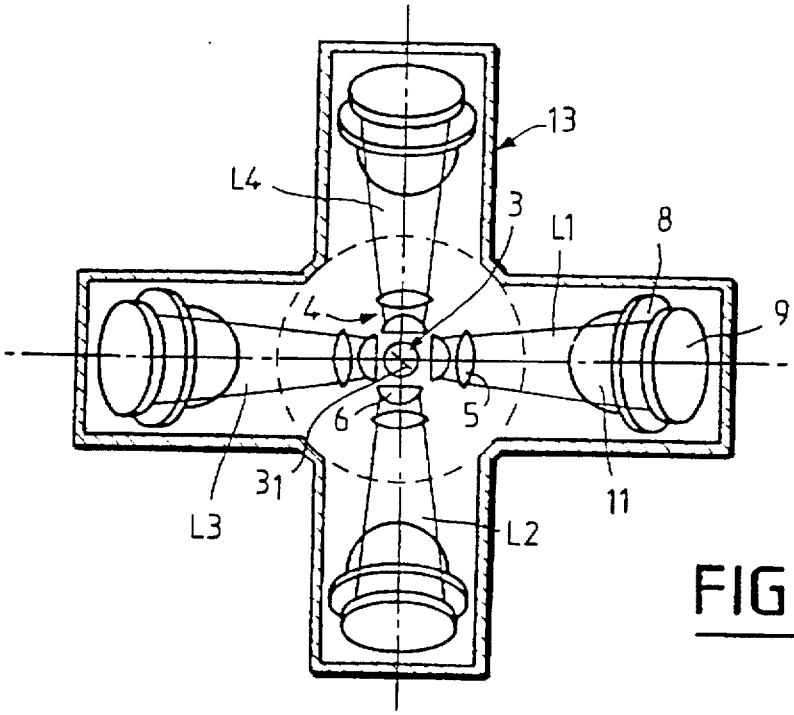
FIG. 2 is a cross section substantially on line II—II of FIG. 1.

As will be seen more particularly from FIGS. 1 and 2, the illuminating projector I according to the invention is adapted in particular for surgical operating rooms. According to this first embodiment, the projector I comprises, in a housing 1, a lighting system 2 comprising a light source 3, from which are formed at least two, and in the illustrated embodiment four, principal light beams $L_1$ to $L_4$. Each light beam $L_1$ to $L_4$ is formed by an optical condenser system 4 comprised for example of two lenses 5 and 6 permitting concentrating a maximum of light energy in a bundle of restricted cross section. As will be seen more particularly in FIG. 2, the optical condenser systems 4 are disposed in immediate adjacency to the light source 3.

The light beams $L_1$ to $L_4$ encounter a return mirror 8 whose reflecting surface is constituted in a conventional manner, by a complex system of thin interferential layers permitting reflecting only visible light whilst letting pass heat rays. Thus, the heat rays pass through each of the mirrors 8 and are received by an end element 9 forming a radiator, so as to ensure elimination of the heat rays. It will thus be seen that the light energy is reflected toward the field to be illuminated, with return mirrors 8 which are each inclined facing a passage port 11 for a light beam. The return mirrors 8 are inclined to form converging beams whose axes A are distributed on the generatrices of a cone whose summit S coincides with the center of the field 12 to be illuminated in a plane P.

The passage ports 11 are provided in the wall of the housing 1 disposed facing the plane P to be lighted. According to a preferred modification, each passage port 11 is provided in an arm 13 extending radially from the center of the housing which is in the form of a central casing 14. As will be seen from the drawings, the central casing 14 of the housing contains the light source 3 and the optical condenser systems 4, whilst the radial arms 13, four in the illustrated example, each comprise a passage port 11 and the associated mirror 8.

Figure 3:
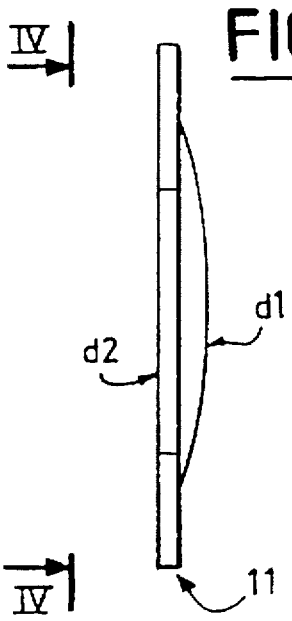
FIG. 3 is a side view of an embodiment of an optical element according to the invention.
Figure 4:
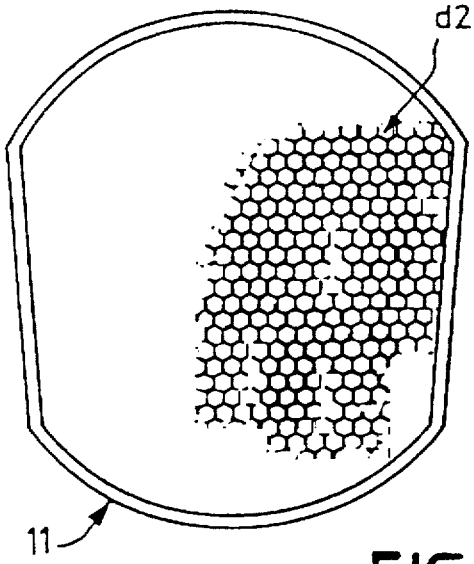
FIG. 4 is a front external view of the optical element taken substantially on the line IV—IV of FIG. 3.

According to the invention, each passage port 11 constitutes an optical element adapted to form an image of the light source 3 in the plane P to be illuminated, as will be seen more particularly in FIGS. 3 and 4, each passage port 11 comprising, on the one hand, a first lens surface $d_1$ ensuring focussing of the filament of light source 3 on the surface 12 to be illuminated, whilst optimizing the correction of optical aberrations, and, on the other hand, a second lens surface $d_2$ ensuring multiplication of the image of the light source 3 to permit uniform illumination of the illuminated plane P. The first lens surface $d_1$ thus constitutes a transparent surface designed to form the image of the light source in the plane to be illuminated and to eliminate particularly at the border of the illuminated field, colored hallows constituting optical aberrations, such as lateral chromatism or coma. In the example shown in FIG. 3, the first lens surface $d_1$ has a spherical profile. The second lens surface $d_2$ ensures a multiplication of the number of images of the light source 3, so as to obtain uniformity of the illuminated field. For example, the second lens surface $d_2$ can be constituted by a multitude of small surfaces which are spherical, aspherical or prismatic, arranged in a matrix, as shown clearly in FIG. 4.

Preferably, each optical element 11 is constituted by a monoblock element composed of the first and second lenses. Also preferably, the first lens surface $d_1$ is constituted by the internal surface directed toward the associated return mirror 8, whilst the second lens surface $d_2$ is formed by the external surface directed toward the plane P to be illuminated.

According to a preferred characteristic of the invention, each optical element 11 has a first lens surface $d_1$ having powers that are different in two directions, so as to ensure better focussing of the light source as a function of the light source's geometry and the light source's position. Thus, as seen more particularly in FIG. 2, the light source 3 is mounted such that its filament $3_1$ will be disposed substantially on a diagonal relative to the optical axes of the different light beams $L_1$ to $L_4$. The internal lens surface $d_1$ thus has a profile which varies as position of the light source and as the geometry of the light source 3.

As is seen more particularly in FIG. 1, the light source 3 is disposed, preferably but not necessarily, such that a portion of its light beam, leaving at its summit, will be collected by an optical condenser system 4 to form a light beam $L_5$ directed toward a direct passage port $11_1$ constituting an optical element analogous to the elements 11 of the invention. The direct passage port 11 is provided in the casing 14 of the housing, centered on the optical axis O of the projector passing through the center of the illuminated field 12. The formation of five light beams $L_1$ to $L_5$ permits optimizing the light output of the projector according to the invention.

Figure 5:
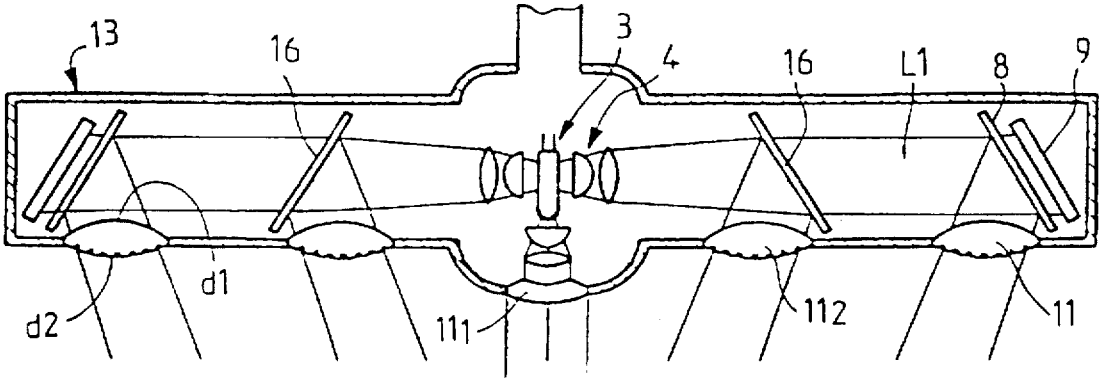
FIG. 5 is a partial vertical cross-sectional view showing another embodiment of a projector according to the invention.

FIG. 5 shows another modified embodiment of a projector according to the invention, comprising an intermediate return mirror 16 interposed in the path of each principal light beam $11_1$ to $11_4$. Each intermediate return mirror 16 is designed to let pass a portion of the beam and to deliver another portion directed toward a passage port $11_2$ according to the invention, in a manner analogous to the optical elements 11. In the example shown in FIG. 5, a single intermediate return mirror 16 is disposed on the path of each of the light beams $11_1$ to $11_4$. Of course, several intermediate return mirrors 16 could be arranged one behind another, along each of the light beams, the derived light beams being directed each toward an optical element $11_2$ according to the invention.

According to this modification, the optical paths of the light beams passing through the ports 11 and $11_2$ are different. According to a preferred modification, the first lens surface $d_1$ of the optical elements 11, $11_1$, $11_2$ are adapted to form the image of the light source 3 in a single common plane P, such that the contributions of each beam passing through the ports 11 to $11_2$ will be substantially identical geometrically. As a result, there will be a superposition of the spots created by each of the light beams, which permits obtaining an illuminated field 12 with a uniform outline. It should therefore be considered that the first lens surface $d_1$ ensure in each embodiment, a supplemental function of adapting the size of the spots. In the preferred embodiment described above, the first lens surface $d_1$ are so arranged that the spots created by each of the beams from the ports have substantially the same size in a same plane P. It is to be noted that in certain applications, it could be provided that the first lens surface $d_1$ of the optical elements be adapted to form the image of the light source in at least two planes offset along the optical axis O of the projector.

Figure 6:
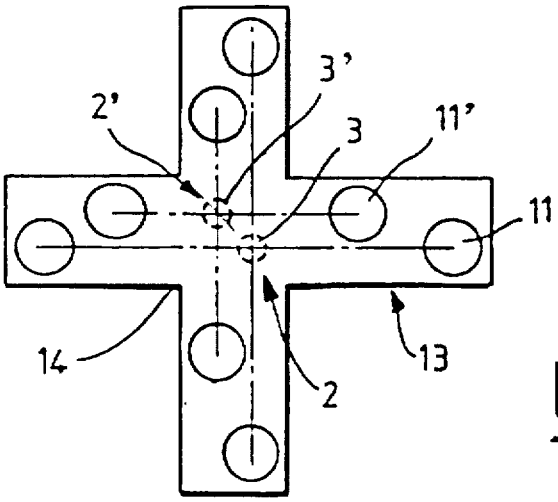
FIG. 6 is a schematic view showing another embodiment of the invention.

In the above description, the projector I comprises a lighting system 2 comprised of a single light source 3, from which are formed as desired a direct light beam and either four (FIGS. 1, 2) or eight (FIG. 5) principal light beams. Of course, there could be provided a lighting system comprising a different number of principal light beams. Similarly, a projector could comprise several lighting systems, such as shown by way of example in FIG. 6. According to this modification, the projector I comprises two lighting systems 2 and 2' whose light sources 3 and 3' are disposed in the central casing 14, whilst the return mirrors and the optical elements 11, 11' of each of the lighting systems are disposed in the radial arms 13. A projector comprising a number of lighting systems 2, 2' greater than two and comprising or not one or several intermediate return mirrors 16 could be provided.

The invention is not limited to the examples described and shown, because various modifications can be given it without departing from its scope.

What is claimed is:

1. A light projector comprising:

a housing;

a light source in the housing;

said light source providing at least two light beams, each light beam having a path;

a mirror disposed on each said path;

optical elements on said housing adapted to form an image of the light source in a plane to be illuminated, after reflection from respective ones of said mirrors;

each said optical element having a first lens surface focussing the light from said light source on the plane to be illuminated while optimizing correction of optical aberrations and a second lens surface multiplying the image of the light source to permit uniform lighting in the plane to be illuminated, said first lens surface and said second lens surface being non-parallel and being disposed on opposite sides of said optical element.

2. A projector according to claim 1, further comprising respective intermediate return mirrors each interposed between a said mirror and the light source and each letting pass a portion of the at least two light beams in a direction of a respective return mirror.

3. A projector according to claim 1, wherein the optical elements are so arranged that respective first lens surfaces permit forming the image of the light source in a single common plane.

4. A projector according to claim 1, wherein the optical elements are so arranged that respective first lens surfaces permit forming the image of the light source in at least two planes offset along an optical axis of the projector.

5. A projector according to claim 1, wherein each optical element includes a monoblock element delimited on opposite sides by the first surface and the second surface.

6. A projector according to claim 1, wherein each optical element has a respective first lens surface having different powers in two directions, so as to optimize the focussing of the light source as a function of the light source's geometry and position.

7. A projector according to claim 1, said housing further comprising a plurality of arms, and in a central region of said housing of the projector, said light source and at least four optical condenser systems each forming a light beam, and in each of said plurality of arms prolonging the central region of the housing, at least one optical element and a respective return mirror.

* * * * *